US011255212B2

(12) United States Patent
Schnieder et al.

(10) Patent No.: US 11,255,212 B2
(45) Date of Patent: Feb. 22, 2022

(54) BLADE TO STATOR HEAT SHIELD INTERFACE IN A GAS TURBINE

(71) Applicant: ANSALDO ENERGIA SWITZERLAND AG, Baden (CH)

(72) Inventors: Martin Schnieder, Ennetbaden (CH); Beat Von Arx, Trimbach (CH); Marcel Koenig, Wettingen (CH); Francesco Garbuglia, Nussbaumen (CH); Günter Filkorn, Nussbaumen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 297 days.

(21) Appl. No.: 15/816,530

(22) Filed: Nov. 17, 2017

(65) Prior Publication Data

US 2018/0142566 A1 May 24, 2018

(30) Foreign Application Priority Data

Nov. 18, 2016 (EP) ..... 16199696

(51) Int. Cl.
*F01D 11/18* (2006.01)
*F01D 5/20* (2006.01)
*F01D 25/28* (2006.01)

(52) U.S. Cl.
CPC ..... *F01D 11/18* (2013.01); *F01D 5/20* (2013.01); *F01D 25/28* (2013.01);
(Continued)

(58) Field of Classification Search
CPC ..... F05D 2300/505; F01D 5/20; F01D 25/28; F01D 11/18
See application file for complete search history.

(56) References Cited

U.S. PATENT DOCUMENTS 4,131,388 A * 12/1978 Brodell ..... F01D 11/18 415/127
5,593,278 A 1/1997 Jourdain et al.
(Continued)

FOREIGN PATENT DOCUMENTS

EP 0 924 388 A2 6/1999
EP 2 527 600 A1 11/2012
(Continued)

OTHER PUBLICATIONS

Espacenet machine translation of Hiratani et al. (WO 2016063604) (Year: 2016).*
(Continued)

*Primary Examiner* — Courtney D Heinle
*Assistant Examiner* — Andrew Thanh Bui
(74) *Attorney, Agent, or Firm* — Buchanan Ingersoll & Rooney PC

(57) ABSTRACT

Gas turbine unit having an axis parallel to the main gas flow, the gas turbine unit comprising:

a blade having a tip;

a stator heat shield having an inner surface facing the blade tip;

wherein the inner surface of the stator heat shield and the blade tip define a variable clearance depending on the applied thermal condition;

wherein the blade tip is configured to have a cylindrical shape along the axial direction in a hot running condition starting from a conical shape along the axial direction in a cold starting condition.

12 Claims, 3 Drawing Sheets

(52) U.S. Cl.
CPC ..... *F05D 2220/32* (2013.01); *F05D 2240/11* (2013.01); *F05D 2240/15* (2013.01); *F05D 2240/307* (2013.01); *F05D 2250/231* (2013.01); *F05D 2250/232* (2013.01)

(56) References Cited

U.S. PATENT DOCUMENTS

| | | | | |
|---|---|---|---|---|
| 6,126,390 | A | 10/2000 | Böck | |
| 6,361,273 | B1 * | 3/2002 | Eng | F01D 9/00 415/173.1 |
| 7,448,846 | B2 * | 11/2008 | Ruthemeyer | F01D 11/12 415/135 |
| 10,174,623 | B2 * | 1/2019 | Scott | F04D 29/522 |
| 2012/0301280 | A1 | 11/2012 | Szwedowicz et al. | |
| 2013/0101391 | A1 | 4/2013 | Szwedowicz et al. | |

FOREIGN PATENT DOCUMENTS

| | | | |
|---|---|---|---|
| EP | 2 570 615 | A1 | 3/2013 |
| EP | 2578805 | A1 | 4/2013 |
| JP | 57-195803 | A | 12/1982 |
| WO | 2016063604 | A1 | 4/2016 |

OTHER PUBLICATIONS

European Search Report of European Patent Application No. 16 19 9696 dated Apr. 20, 2017.

Office Action (Communication Pursuant to Rule 114(2) EPC) dated Apr. 11, 2019, by the European Patent Office in corresponding European Patent Application No. 16199696.2. (4 pages).

First Office Action dated May 17, 2021, by the Chinese Patent Office in corresponding Chinese Patent Application No. 201711145190.6, and an English Translation of the Office Action. (13 pages).

* cited by examiner

BLADE TO STATOR HEAT SHIELD INTERFACE IN A GAS TURBINE

PRIORITY CLAIM

This application claims priority from European Patent Application No. 16199696.2 filed on Nov. 18, 2016, the disclosure of which is incorporated by reference.

BACKGROUND OF THE INVENTION

Field of the Invention

The present invention refers to a gas turbine unit.

In particular, the present invention relates to the interface between the blades and the stator heat shield located outwardly the blades. This interface is therefore defined at the rotor side by the blade tip and at the stator side by the inner surface of the stator heat shield.

More in particular, the present invention relates to a pre-shaped blade tip and a pre-shaped stator heat shield suitable for realizing a blade to stator heat shield interface having different configurations in cold starting condition and in hot running condition.

DESCRIPTION OF PRIOR ART

In a gas turbine unit, the stator heat shield and the rotating blades, inwardly arranged with respect to the stator heat shield, define an interface that on one side allows the blades to rotate end on another side prevents the flow of the hot gas over the tip. Indeed, this passage of the hot gas over the blade tip, called "over tip flow", causes oxidation and performance loss. Therefore, the clearance at the blade to stator heat shield interface has to be controlled in order to reduce the above reported over tip flow.

Moreover, from a cold starting condition to a hot running condition the blade tip and the stator heat shield modify the relative original shapes due to the different applied thermal condition.

In particular, the stator heat shield deforms axially along the turbine axis, and along the circumferential direction. On the rotor side, the blade tip deforms axially and radially.

FIGS. 1-4 show how the blade tip to stator heat shield interface thermally deforms according to prior art from a cold starting condition to a hot running condition.

FIG. 1 is a schematic view along the axis A parallel to main flow M. This figure discloses a blade tip to stator heat shield interface according to prior art in a cold starting condition. According to the prior art, along the axis A the blade tip is cylindrical tip in the cold starting condition. The term "cylindrical" means that the blade tip, i.e. the outer edge of the blade facing the stator heat shield, is a surface defined by a plurality of straight lines parallel to the axis A.

During the hot running condition, or steady condition, the thermal load applied to the blade tip is not equal along the axial direction. In particular, the thermal load applied to the blade tip increases along the axial direction following the main flow direction M. Starting to an initial cylindrical condition, and due to the above-mentioned unequal thermal load, the tip in hot running condition comprises a tip trailing edge having a higher radial expansion with respect to the tip leading edge. In other words, the tip blade according to the prior art, as disclosed in FIG. 2, becomes "conical" in the hot running condition.

Referring to the FIG. 1, according to the prior art the inner surface of the stator heat shield in the cold condition is "cylindrical" along the axial direction. In other words, the inner surface of the stator heat shield is defined by a plurality of straight lines parallel to the axis A.

During the hot running condition, the applied thermal load to the stator heat shield discloses a maximus value at the middle of the inner surface of the stator heat shield along the axial direction.

Due to this applied thermal load, the inner surface of the stator heat shield in hot running condition discloses a curved inner surface with a maximus thermal expansion, toward the blade, located at the middle of the inner surface of the stator heat shield along the axial direction.

The above modification along the axial direction of the blade to the stator heat shield interface from the cold to the hot condition is disclosed in FIG. 2 wherein in dash lines are reported the original "cold" shapes of the blade tip and of the stator heat shield.

FIG. 3 is a schematic view along a circumferential direction orthogonal and centered to the axis A of the of blade tip to stator heat shield interface according to prior art in the cold starting condition. As disclosed in FIG. 1, the stator heat shield comprise a plurality of hook members arranged on the opposite side with respect to the blade and are configured to couple the stator heat shield to the vane carrier.

According to the prior art embodiment of FIG. 3, in the cold starting condition the inner surface of the stator heat shield discloses a curved shape along the circumferential direction that is equal to the curved inner surface of the annulus, reported in FIG. 3 in dash line. According to this embodiment, also the inner surface of the hook members discloses a curved shape along the circumferential direction that is equal to the curved inner surface of the vane carrier, reported in FIG. 3 in dash line.

The thermal load applied in hot condition along the circumferential direction has a maximus value located in the middle of the inner surface of the stator heat shield.

Due to this thermal load, the inner surface of the stator heat shield, along the circumferential direction, discloses a curve shape with a maximus thermal expansion, toward the blade, located at the middle of the inner surface.

Also at the inner surface of the hook elements is applied a same thermal load and therefore in the middle of the hook elements, along the circumferential direction, the hook is pressed against the vane carrier. As a consequence, laterally a clearance is present between the hook inner surface and the vane carrier.

With reference to FIGS. 2 and 4, according to the prior art during the hot running condition the blade to stator heat shield interface does not define a cylindrical passage and therefore this passage in sensitive to axial movement and does not allow to control the overtip flow and, therefore, the performance of the gas turbine unit.

SUMMARY OF THE INVENTION

Accordingly, a primary object of the present invention is to provide a blade to stator heat shield interface in a gas turbine that allows to control and reduce the tip clearance in order to reduce the overtip flow, to increase the efficiency and performance and to increase the lifetime.

In order to achieve the objective mentioned above, the present invention provides a gas turbine unit having an axis parallel to the main gas flow, wherein the gas turbine unit comprises:

- a rotating blade having a tip;
- a stator heat shield arranged outwardly with respect to the blade and having an inner surface facing the blade tip.

The terms "outwardly", or "outer", and "inwardly", or "inner", refer to the axis A of the gas turbine unit. Therefore, a component arranged outwardly means that it is placed at a higher distance from the axis A with respect to a inner component.

The inner surface of the stator heat shield and the blade tip, in particular the outer surface of the blade tip, define a variable clearance, or over tip variable passage, depending on the thermal condition.

In particular, according to a first aspect of the invention the blade tip is configured to thermally deform in order to have a cylindrical shape along the axial direction in the hot running condition starting from a conical shape along the axial direction in the cold starting condition.

The term "cylindrical" along the axial direction means that the blade tip surface is defined by a plurality of straight lines parallel to the axis A.

Advantageously, the a cylindrical shape of the blade tip along the axial direction allows to realize, at least at the rotor side, a uniform and controlled radial over tip clearance insensitive to the axial movement.

In particular, the blade tip comprises a leading edge and a trailing edge, wherein in the cold starting condition along the axial direction the tip leading edge is arranged at a higher distance from the axis A than the tip trailing edge. In the hot running condition along the axial direction the tip trailing edge and the tip leading edge are arranged at the same distance from the axis A.

In particular, in the cold starting condition along the axial direction a straight line T connecting the leading edge to the trailing edge defines with the axis A an angle comprise between 1° and 2°, preferably 1.5°.

According to another aspect of the invention, also the inner surface of the stator heat shield is configured to thermally deform in order to have a cylindrical shape along the axial direction in the hot running condition starting from a non-cylindrical shape along the axial direction in the cold starting condition.

Advantageously, the above cylindrical shape along the axial direction of the inner surface of the stator heat shield allows to realize also at the stator side an uniform and controlled radial clearance insensitive to the axial movement.

In particular, the inner surface of the stator heat shield comprises an upstream edge and a downstream edge wherein the terms upstream and downstream refer to the main gas flow direction. In the cold starting condition along the axial direction the upstream edge and a downstream edge are closer to the axis A than a middle portion of the inner surface of the stator heat shield. The middle portion of the inner surface of the stator heat shield is the portion facing the blade tip. In the hot running condition, along the axial direction the upstream edge, the downstream edge and the middle portion of the inner surface of the stator heat shield are arranged at the same distance from the axis A.

In particular, in the cold starting condition along axial direction the downstream edge and the upstream edge are arranged at the same distance from the axis A. Moreover, in the cold starting condition along axial direction the middle portion of the inner surface of the stator heat shield is rounded connected to the upstream edge and the downstream edge.

According to another aspect of the invention, the inner surface of the stator heat shield is configured to thermally deform in a controlled manner not only along the axial direction, but also along a circumferential direction centered in the axis A. In particular, the gas turbine comprises an annulus, that is a fluid passage into which the hot gases are guided. This annulus comprises an inner surface that is curved along the circumferential direction. The inner surface of the stator heat shield is configured to thermally deform in order to have in the hot running condition the same curved shape along the circumferential direction. On the contrary, in the cold starting condition a middle portion inner surface of the stator heat shield along the circumferential direction is arranged at a higher distance from the axis A than the annulus inner surface.

In particular, the gas turbine comprises a vane carrier suitable to be connected to the outer surface of the stator heat shield. The vane carrier, that supports connect all the stator parts, comprises a inner curved surface along a circumferential direction whereas the outer surface of the stator heat shield comprises a plurality of hooks upstream oriented and configured to couple to the inner curved surface of the vane carrier. Preferably, the stator heat shield comprise a leading edge hook, upstream arranged with respect to the main hot gas flow, a trailing edge hook, downstream arranged with respect to the main hot and at least a middle hook located between the leading and the trailing hook.

The hooks comprise an inner surface, facing the outer surface of the stator heat shield, configured to thermally deform in order to have a curved shape along circumferential direction equal to curved inner surface of the vane carrier in the hot running condition. In particular, in the cold starting condition, the middle portion of the middle hook inner surface along circumferential direction is arranged at a higher distance from the axis A than the curved inner surface of the vane carrier. In this condition, the side portions of the middle hook inner surface along the circumferential direction is in abutment with the vane carrier.

Advantageously, in the hot running condition the hooks coupled as above described to the vane carrier limit the expansion of the stator heat shield in order to have the foregoing desired cylindrical shape. Indeed, in the hot running condition both the middle portion and the side portions of the middle hook inner surface along circumferential direction are in abutment with the vane carrier. In this way, the middle clearance is not less (equal or greater) than the side clearances between hook and vane carrier.

The presence of such hooks as describe on the outer surface of the stator heat shield can also be independent with respect the pre-shaping of the blade tip. Indeed, the kooks allow independently to avoid undue deformation of the stator heat shield.

Of course, the simultaneously presence of such hooks and the described pre-shaping of the blade tip allow the blade tip to stator heat shield interface to be cylindrical during the hot running condition on both interface sides.

The leading edge hook and the trailing edge hook deform in the same way with respect to the middle hook.

The invention has been described for unshrouded blade without any abradable coating system. However, the invention could be applied also to these kinds of blade features.

It is to be understood that both the foregoing general description and the following detailed description are exemplary, and are intended to provide further explanation of the invention as claimed. Other advantages and features of the invention will be apparent from the following description, drawings and claims.

The features of the invention believed to be novel and inventive are set forth with particularity in the appended claims.

BRIEF DESCRIPTION OF DRAWING

Further benefits and advantages of the present invention will become apparent after a careful reading of the detailed description with appropriate reference to the accompanying drawings.

The invention itself, however, may be best understood by reference to the following detailed description of the invention, which describes an exemplary embodiment of the invention, taken in conjunction with the accompanying drawings, in which.

DETAILED DESCRIPTION OF THE INVENTION

Figure 1:
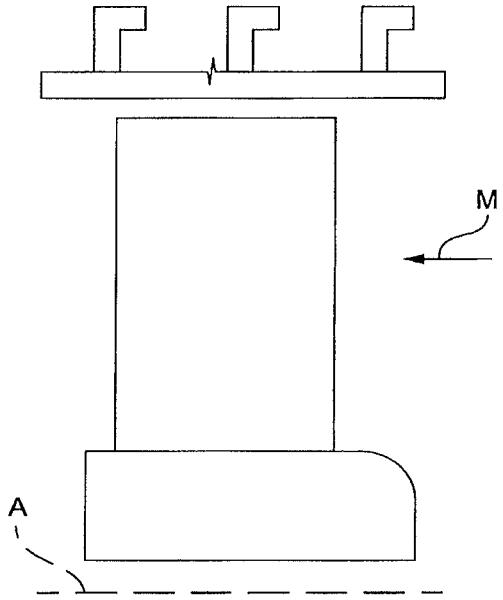
Fig. 1 Prior Art
FIG. 1 is a schematic view along the axial direction of the blade tip to stator heat shield interface according to the prior art in the cold starting condition.
Figure 2:
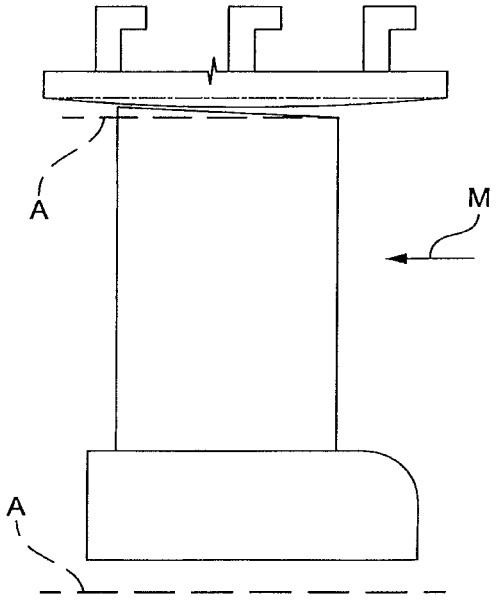
Fig. 2 Prior Art
FIG. 2 is a schematic view along the axial direction of the blade tip to stator heat shield interface according to the prior art in the hot running condition.
Figure 3:
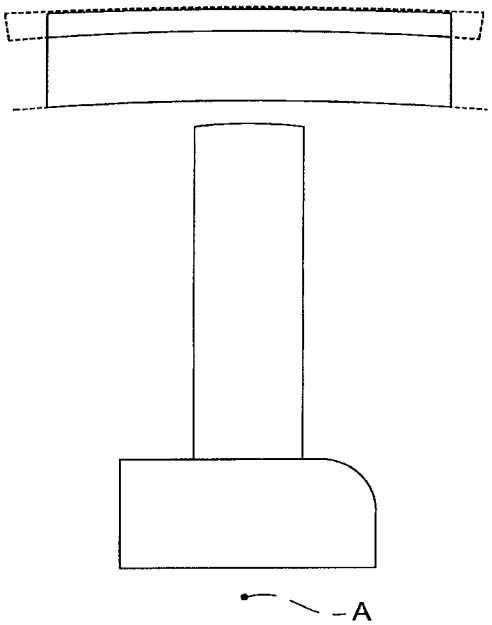
Fig. 3 Prior Art
FIG. 3 is a schematic view along the circumferential direction of the blade tip to stator heat shield interface according to the prior art in the cold starting condition.

In cooperation with the attached drawings, the technical contents and detailed description of the present invention are described thereinafter according to preferable embodiments, being not used to limit its executing scope. Any equivalent variation and modification made according to appended claims is all covered by the claims claimed by the present invention.

Reference is now made to the drawing FIGS. 5-9 to describe the present invention in detail. In particular, the FIGS. 5-9 disclose a blade 1 with a blade tip 2 and a stator heat shield 3 with an inner surface 4. The blade tip 2 and the inner surface 4 of the stator heat shield 3 are configured to thermally deform under the hot running condition to have a controlled cylindrical shape along the axial direction. This particular shape allows to control and to reduce the tip clearance, to reduce the overtip flow, to increase the efficiency and performance and to increase the lifetime.

From the following description it will be clear that the blade tip 2 and the inner surface 4 of the stator heat shield 3 become cylindrical along the axial direction due to a particular "pre-shaping" provided in the cold condition.

Figure 5:
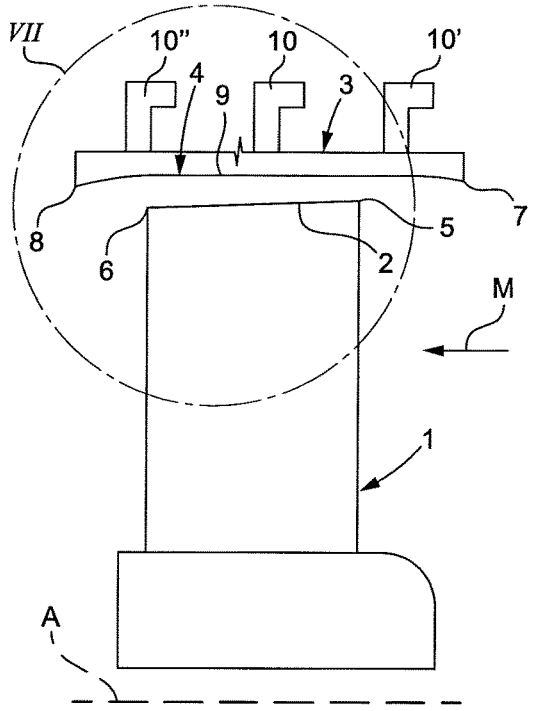
FIG. 5 is a schematic view along the axial direction of the blade tip to stator heat shield interface according to an embodiment of the invention in the cold starting condition.
Figure 7:
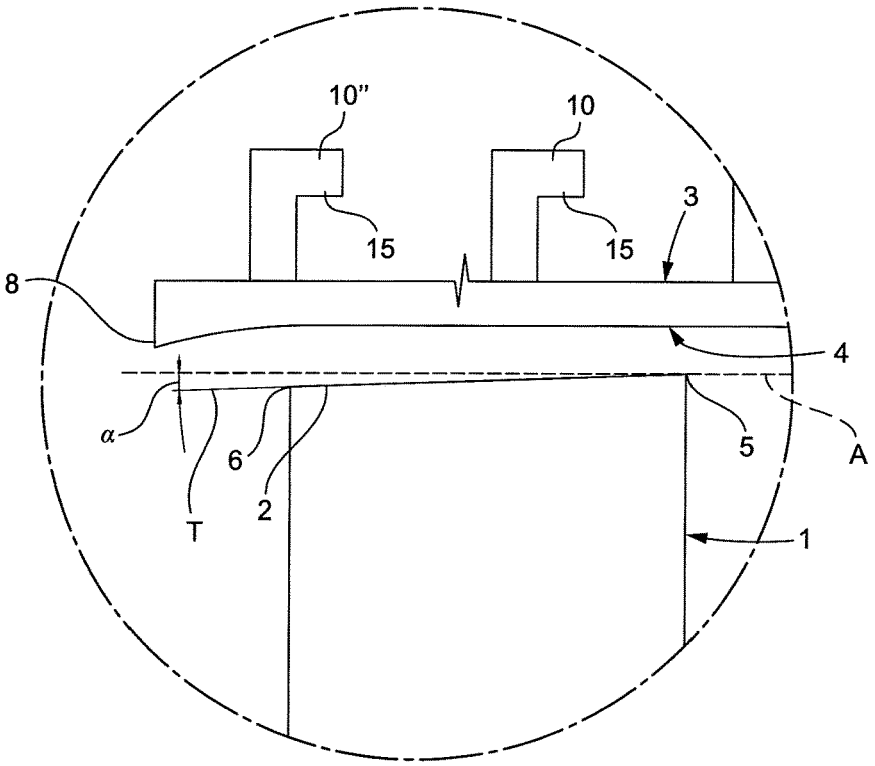
FIG. 7 is an enlarged view of a portion of FIG. 5.

Reference is made to FIG. 5, which is a schematic view along the axial direction A, parallel to the main gas flow M, of the blade 1 to stator heat shield 3 interface according to an embodiment of the invention in the cold starting condition, Reference is also made to FIG. 7, which is an enlarged view of a portion of FIG. 5.

In particular, FIGS. 5 and 7 disclose a blade 1 having a tip 2, a stator heat shield 3 having a inner surface 4 facing the blade tip 2. Referring to the main gas flow direction M, the blade tip 2 comprises a leading edge 5 a trailing edge 6, wherein along the axial direction the leading edge 5 is arranged at a higher distance from the axis A than the tip trailing edge 6. In other words, as disclosed in FIG. 7, the tip 2 in the cold start condition is "conical", i.e. the straight line T connecting the leading edge 5 to the trailing edge 6 defines with the axis A and angle $\alpha$ between 1° and 2°, preferably 1.5°.

The inner surface 4 of the stator heat shield 3 comprises an upstream edge 7 and a downstream edge 8. In the cold starting condition disclosed in FIGS. 5 and 7, along the axial direction the downstream edge 8 and the upstream edge 7 are closer to the axis A than the middle portion 9 of the inner surface 4 of the stator heat shield 3. Moreover, in the cold starting condition the downstream edge 8 and the upstream edge 7 are arranged at the same distance from the axis A and the middle portion 9 of the inner surface 4 of the stator heat shield 3 is rounded connected to the upstream edge 7 and to the downstream edge 8.

Figure 6:
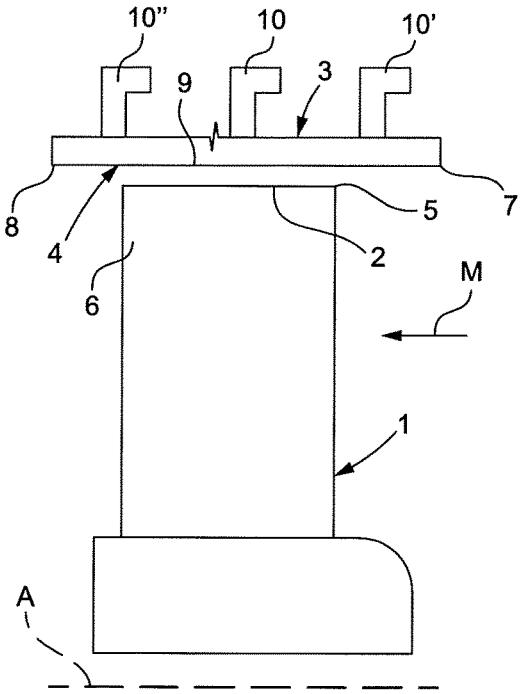
FIG. 6 is a schematic view along the axial direction of the blade tip to stator heat shield interface according to an embodiment of the invention in the hot running condition.

Reference is made to FIG. 6, which is a schematic view along the axial direction of the blade tip 2 to stator heat shield 3 interface according to an embodiment of the invention in the hot running condition.

Starting from the shape disclosed in FIG. 5, under the hot running condition the blade tip 2 and the inner surface 4 deform up to generate a shape as disclosed in FIG. 6. In particular, in FIG. 6 the tip leading edge 5 and the tip trailing edge 6 are aligned at the same distance from the axis A and the tip surface 2 is cylindrical along the axial direction, i.e. defined by a plurality of straight lines parallel to axis A.

FIG. 6 discloses also the shape of the inner surface 4 of the stator heat shield 3 in the hot running condition. In particular, in this thermal condition, along the axial direction the downstream edge 8, the upstream leading edge and the middle portion 9 of the inner surface 4 are aligned at the same distance from the axis A. The inner surface 4 is therefore cylindrical along the axial direction, i.e. defined by a plurality of straight lines parallel to axis A.

Figure 8:
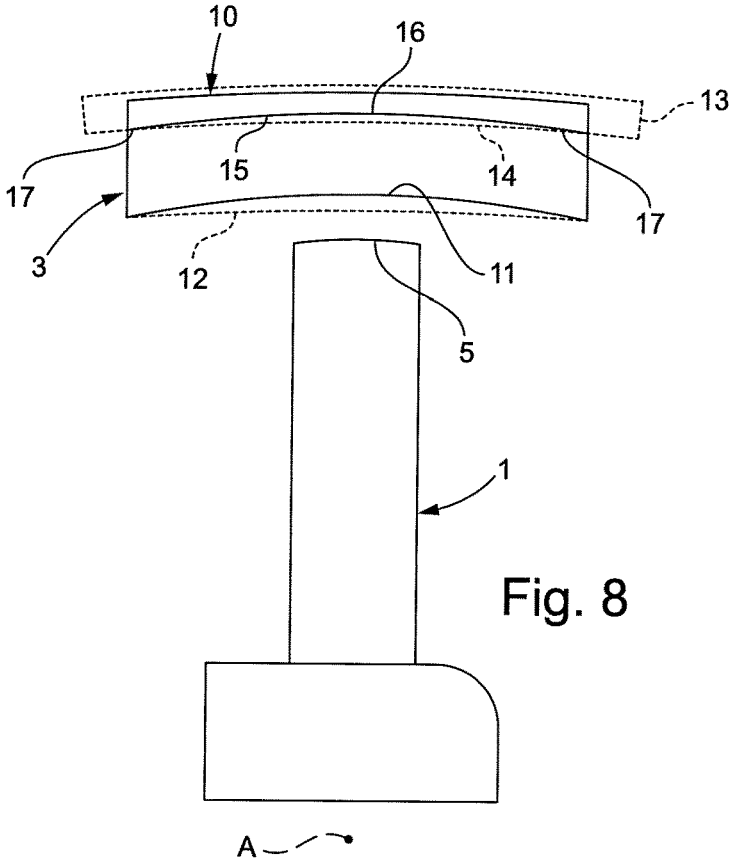
FIG. 8 is a schematic view along the circumferential direction of the blade tip to stator heat shield interface according to an embodiment of the invention in the cold starting condition.
Figure 9:
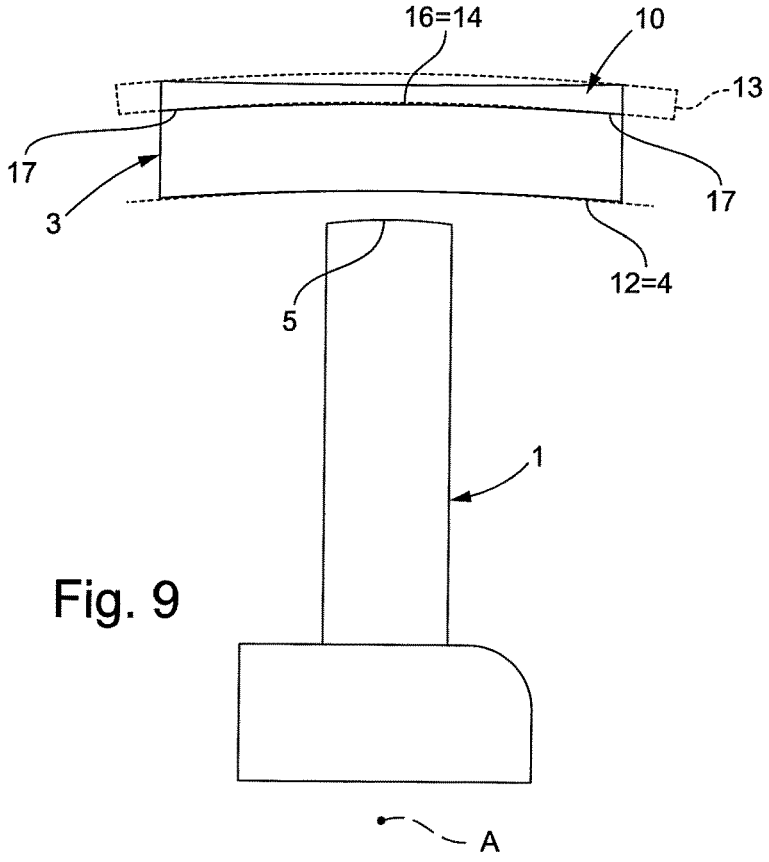
FIG. 9 is a schematic view along the circumferential direction of the blade tip to stator heat shield interface according to an embodiment of the invention in the hot running condition.

Reference is made to FIGS. 8 and 9, which are schematic views along the circumferential direction of the blade tip 2 to stator heat shield 3 interface according to an embodiment of the invention in the cold starting condition and in the hot running condition. In FIGS. 8 and 9 the numbers 12 and 13 refer respectively to the anulus and to the vane carrier of the gas turbine unit. These components have been represented only with dashed lines.

In detail, reference is made to FIG. 8, which is a schematic view along the circumferential direction of the blade tip 2 to stator heat shield 3 interface according to an embodiment of the invention in the cold starting condition. The anulus 12 comprises an inner curved surface along the circumferential direction. In the cold starting condition, the inner surface 4 of the stator heat shield 3 is configured to have a curved shape along circumferential direction non-equal to the anulus 12. In particular, the middle portion 11 of the inner surface 4 along the circumferential direction is arranged at a higher distance from the axis A than the anulus surface.

Similarly, the vane carrier 13 comprises a curved inner surface 14 along the circumferential direction whereas the outer surface of the stator heat shield 3 comprises a plurality of hooks oriented upstream to the main flow M and configured to couple to the vane carrier 13. According to the embodiment disclosed in the figures, the stator heat shield comprises three hooks, namely a leading edge hook 10', upstream arranged with respect to the main hot gas flow, a trailing edge hook 10", downstream arranged with respect to the main hot and a middle hook 10 located between the leading and the trailing hook.

In particular, FIGS. 8 and 9 disclose the deformation of the middle hook 10 starting from a cold condition, FIG. 8, to a hot running condition, FIG. 9.

In the cold starting condition of FIG. 8, the hook inner surface 15 is configured to have a curved shape along the circumferential direction non-equal to the vane carrier curved inner surface 14. In particular, the middle portion 16 of the hook inner surface 15 is arranged at a higher distance from the axis A than the curved inner surface 14 of the vane carrier. In this condition, the side portions of the middle hook inner surface 16 along circumferential direction are in abutment with the vane carrier 13.

Reference is made to FIG. 9, which is a schematic view along the circumferential direction of the blade tip to stator heat shield interface according to an embodiment of the invention in the hot running condition.

Starting from the shape disclosed in FIG. 8, under the hot running condition, the middle hook 10 and the inner surface 4 of the stator heat shield 3 deform up to generate a shape as disclosed in FIG. 9. In particular, in figure the inner surface 4 of the stator heat shield 3 is aligned to the anulus curved surface 12 and the hook inner surface 15 is aligned to carrier curved inner surface 14.

Figure 4:
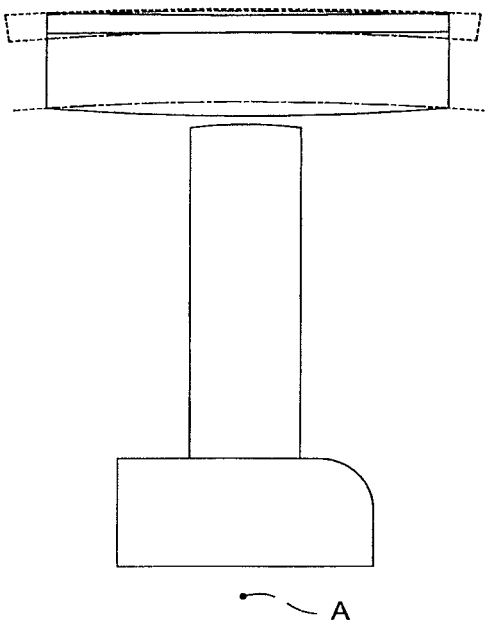
Fig. 4 Prior Art
FIG. 4 is a schematic view along the circumferential direction of the blade tip to stator heat shield interface according to the prior art in the hot running condition.

As disclosed in FIG. 9, in the hot running condition both the middle portion 16 and the side portions 17 of the middle hook inner surface 15 along circumferential direction are in abutment with the vane carrier 13. In this way, the middle clearance is not less (equal or greater) than the side clearances between the middle hook 10 and the vane carrier 13. On the contrary, FIG. 4 of the prior art disclose side clearances larger than the middle clearance between the hook and the vane carrier.

Although the invention has been explained in relation to its preferred embodiment(s) as mentioned above, it is to be understood that many other possible modifications and variations can be made without departing from the scope of the present invention. Therefore, It is contemplated that the appended claim or claims will cover such modifications and variations that fall within the true scope of the invention.

The invention claimed is:

1. Gas turbine unit having a central axis (A) parallel to a main gas flow, the gas turbine unit comprising:

a blade having a tip, a leading edge and a trailing edge; and a stator heat shield having an inner surface facing the blade tip;

wherein the inner surface of the stator heat shield and the blade tip define a variable clearance depending on a thermal condition; and wherein:

wherein the blade tip includes the leading edge and the trailing edge, configured such that:

when in the cold starting condition, along the axial direction, the leading edge of the blade tip is arranged at a radial distance from the axis (A) that is greater than the radial distance from trailing edge of the blade tip to the axis (A);

when in the hot running condition, along the axial direction, the trailing edge of the blade tip and the leading edge of the blade tip are arranged at a same radial distance from the axis (A); and when in the cold starting condition, along the axial direction, a straight line (T) connecting the leading edge of the blade tip to the trailing edge of the blade tip defines with the axis (A) an angle ($\alpha$) between 1° and 2°; and an annulus having a curved inner surface along a circumferential direction, and wherein the inner surface of the stator heat shield, directly facing the blade tip, is configured to have a curved shape along the circumferential direction equal to the annulus when in the hot running condition, starting from a curved shape along the circumferential direction non-equal to the annulus when in the cold starting condition.

2. Gas turbine unit as claimed in claim 1, wherein the tip is a surface generated by a plurality of straight lines parallel to axis (A).

3. Gas turbine unit as claimed in claim 1, wherein the gas turbine unit comprises:

a vane carrier having a curved inner surface along a circumferential direction;

wherein an outer surface of the stator heat shield includes a plurality of hooks; and wherein a hook inner surface is configured to have a curved shape along the circumferential direction equal to a curved inner surface of the vane carrier when in a hot running condition, starting from a curved shape along the circumferential direction non-equal to the vane carrier curved inner edge when in a cold starting condition.

4. Gas turbine unit as claimed in claim 3, wherein the stator heat shield comprises:

a leading edge hook, arranged upstream with respect to a main hot gas flow;

a trailing edge hook, arranged downstream with respect to the main hot gas flow; and a middle hook located between the leading and the trailing edge hooks.

5. Gas turbine unit as claimed in claim 4, configured such that when in the cold starting condition, a middle portion of the middle hook inner surface is arranged at a radial distance from an axis (A) that is greater than a radial distance from the curved inner edge of the vane carrier to the axis (A), side portions of the middle hook inner surface along the circumferential direction being in abutment with the vane carrier.

6. Gas turbine unit as claimed in claim 5, configured such that when in the hot running condition, a middle clearance between the middle portion of the middle hook inner surface and the vane carrier is equal or greater than side clearances between the side portions of the middle hook inner surface and the vane carrier.

7. Gas turbine unit as claimed in claim 6, configured such that when in the hot running condition, the middle portion of the middle hook inner surface is in abutment with the vane carrier, the side portions of the middle hook inner surface along the circumferential direction being in abutment with the vane carrier.

8. Gas turbine unit as claimed in claim 1, wherein the inner surface of the stator heat shield is configured to have a cylindrical shape along the axial direction in a hot running condition starting from a non-cylindrical shape along the axial direction in a cold starting condition.

9. Gas turbine unit as claimed in claim 8, wherein the inner surface of the stator heat shield comprises:

a upstream edge and a downstream edge, configured such that:

when in the cold starting condition, along an axial direction, the downstream edge and the upstream edge are radially closer to an axis (A) than a middle portion of the inner surface of the stator heat shield; and when in the hot running condition, along the axial direction the downstream edge, the upstream edge and the middle portion of the inner surface of the stator heat shield are arranged at a same radial distance from the axis (A), and the inner surface of the stator heat shield is a surface generated by a plurality of straight lines parallel to axis (A).

10. Gas turbine unit as claimed in claim 9, configured such that when in a cold starting condition, along the axial direction the downstream edge and the upstream edge are arranged at a same radial distance from the axis (A).

11. Gas turbine unit as claimed in claim 10, wherein the middle portion of the inner surface of the stator heat shield is rounded connected to the upstream edge and the downstream edge.

12. Gas turbine unit as claimed in claim 1, configured such that when in the cold starting condition, the middle portion of the inner surface of the stator heat shield along the circumferential direction is arranged at a radial distance from the axis (A) that is greater than the radial distance from the annulus to the axis (A).

* * * * *